US011827497B2

(12) United States Patent
Sanada et al.

(10) Patent No.: US 11,827,497 B2
(45) Date of Patent: Nov. 28, 2023

(54) WORK VEHICLE

(71) Applicants: TADANO LTD., Kagawa (JP); National University Corporation YOKOHAMA National University, Kanagawa (JP)

(72) Inventors: Kazushi Sanada, Kanagawa (JP); Kazuya Tanizumi, Kagawa (JP); Shinji Noguchi, Kagawa (JP); Naoto Kawabuchi, Kagawa (JP)

(73) Assignees: TADANO LTD., Kagawa (JP); NATIONAL UNIVERSITY CORPORATION YOKOHAMA NATIONAL UNIVERSITY, Kanagawa (JP)

( * ) Notice: Subject to any disclaimer, the term of this patent is extended or adjusted under 35 U.S.C. 154(b) by 285 days.

(21) Appl. No.: 17/434,136

(22) PCT Filed: Feb. 21, 2020

(86) PCT No.: PCT/JP2020/007194
§ 371 (c)(1),
(2) Date: Aug. 26, 2021

(87) PCT Pub. No.: WO2020/175399
PCT Pub. Date: Sep. 3, 2020

(65) Prior Publication Data

US 2022/0055872 A1 Feb. 24, 2022

(30) Foreign Application Priority Data

Feb. 27, 2019 (JP) ..... 2019-035018

(51) Int. Cl.
*B66C 23/86* (2006.01)
*F15B 11/042* (2006.01)
(Continued)

(52) U.S. Cl.
CPC ..... *B66C 13/20* (2013.01); *B66C 23/54* (2013.01); *B66C 23/86* (2013.01); *F15B 11/042* (2013.01);
(Continued)

(58) Field of Classification Search
CPC ... F15B 11/042; F15B 11/0423; F15B 11/044; F15B 11/055; B66C 23/86
See application file for complete search history.

(56) References Cited

U.S. PATENT DOCUMENTS 5,421,155 A * 6/1995 Hirata ..... F15B 11/055 60/494
5,701,933 A * 12/1997 Lunzman ..... F04B 49/225 91/450
(Continued)

FOREIGN PATENT DOCUMENTS

JP H10-212092 A 8/1998
JP 3626590 B2 3/2005

OTHER PUBLICATIONS

May 12, 2020, International Search Report issued for related PCT application No. PCT/2020/007194.
(Continued)

*Primary Examiner* — Michael Leslie
(74) *Attorney, Agent, or Firm* — Paratus Law Group, PLLC

(57) ABSTRACT

A work vehicle includes: an operation tool that is operated by an operator; and a controller that determines a target flow rate for hydraulic oil fed to a hydraulic device on a basis of the amount of operation of the operation tool. The controller calculates a bleed-off target flow rate on a basis of the flow rate of hydraulic oil fed from a hydraulic oil pump and the target flow rate for hydraulic oil fed to the hydraulic device, calculates a bleed-off throttle differential pressure on a basis of a pressure of hydraulic oil fed from the hydraulic oil
(Continued)

pump and a pressure of hydraulic oil in a hydraulic oil tank, calculates a bleed-off target opening area on a basis of the bleed-off target flow rate and the bleed-off throttle differential pressure, and controls a hydraulic oil control valve such that the bleed-off target opening area is achieved.

6 Claims, 10 Drawing Sheets

(51) Int. Cl.

| | |
|---|---|
| ***F15B 11/044*** | (2006.01) |
| ***F15B 11/05*** | (2006.01) |
| ***B66C 13/20*** | (2006.01) |
| ***B66C 23/00*** | (2006.01) |
| ***F15B 15/20*** | (2006.01) |
| *B66C 23/42* | (2006.01) |

(52) U.S. Cl.
CPC ..... *F15B 11/044* (2013.01); *F15B 11/0423* (2013.01); *F15B 11/055* (2013.01); *F15B 15/20* (2013.01); *B66C 23/42* (2013.01); *B66C 2700/0371* (2013.01); *F15B 2211/20538* (2013.01); *F15B 2211/3116* (2013.01); *F15B 2211/35* (2013.01); *F15B 2211/7058* (2013.01)

(56) References Cited

U.S. PATENT DOCUMENTS

| | | | | |
|---|---|---|---|---|
| 9,316,236 | B2 * | 4/2016 | Kondo | F15B 9/08 |
| 9,528,531 | B2 * | 12/2016 | Sugano | F15B 11/042 |
| 11,092,173 | B2 * | 8/2021 | Kristensen | F15B 11/044 |
| 11,421,715 | B2 * | 8/2022 | Nakajima | F15B 11/055 |
| 2023/0184265 | A1 * | 6/2023 | Hoshino | F15B 11/0423 60/494 |

OTHER PUBLICATIONS

May 12, 2020, International Search Opinion issued for related PCT application No. PCT/2020/007194.

* cited by examiner

WORK VEHICLE

CROSS REFERENCE TO PRIOR APPLICATION

This application is a National Stage Patent Application of PCT International Patent Application No. PCT/JP2020/007194 (filed on Feb. 21, 2020) under 35 U.S.C. § 371, which claims priority to Japanese Patent Application No. 2019-035018 (filed on Feb. 27, 2019), which are all hereby incorporated by reference in their entirety.

TECHNICAL FIELD

The present invention relates to a work vehicle.

Conventionally, a crane which is a typical work vehicle has been known. A crane mainly includes a travelling body and a slewing body. The travelling body includes multiple wheels and is a self-propelled type. The slewing body includes a wire rope and a hook in addition to a boom, and can transport a load in a lifted state.

Incidentally, there is a crane including a meter-in circuit that guides hydraulic oil from a hydraulic oil pump to a hydraulic device, a meter-out circuit that guides hydraulic oil from the hydraulic device to a hydraulic oil tank, and a bleed-off circuit that guides hydraulic oil from the hydraulic oil pump to the hydraulic oil tank without passing through the hydraulic device (see Patent Literature 1). Such a crane achieves improvement in operation performance by adjusting the opening area of the bleed-off circuit even when the operating state of the hydraulic oil pump changes according to the load applied to an engine.

In this regard, in the crane disclosed in Patent Literature 1, a controller stores the relationship between the operation amount of an operation means and the differential pressure across a bleed-off throttle means. The relationship between the operation amount of the operation means and the differential pressure across the bleed-off throttle means needs to be acquired by repeating an actual machine test and simulation at least for each model. For this reason, there has been a problem that such a crane requires much time and financial costs for research and development. In view of the above, there has been a demand for a technology that makes it possible to improve operation performance and reduce the time and financial costs needed for research and development.

CITATION LIST

Patent Literature

Patent Literature 1: JP 3626590 B2

SUMMARY OF THE INVENTION

Problems to be Solved by the Invention

The present invention provides a technology that makes it possible to improve operation performance and reduce the time and financial costs needed for research and development.

Solutions to Problems

A work vehicle of the present invention is a work vehicle including:

a hydraulic device;

a hydraulic oil pump;

a hydraulic oil tank;

a meter-in circuit that guides hydraulic oil from the hydraulic oil pump to the hydraulic device;

a meter-out circuit that guides hydraulic oil from the hydraulic device to the hydraulic oil tank;

a bleed-off circuit that guides hydraulic oil from the hydraulic oil pump to the hydraulic oil tank without passing through the hydraulic device;

a hydraulic oil control valve that adjusts opening areas of the meter-in circuit, the meter-out circuit, and the bleed-off circuit by sliding of a spool;

an operation tool operated by an operator; and a controller that determines a target flow rate of hydraulic oil to be fed to the hydraulic device on a basis of an operation amount of the operation tool, wherein the controller calculates a bleed-off target flow rate on a basis of a flow rate of the hydraulic oil fed from the hydraulic oil pump and a target flow rate of the hydraulic oil fed to the hydraulic device, calculates a bleed-off throttle differential pressure on a basis of a pressure of the hydraulic oil fed from the hydraulic oil pump and a pressure of the hydraulic oil in the hydraulic oil tank, calculates a bleed-off target opening area on a basis of the bleed-off target flow rate and the bleed-off throttle differential pressure, and controls the hydraulic oil control valve such that the bleed-off target opening area is achieved.

In the work vehicle of the present invention, when the bleed-off target flow rate is Qb, the bleed-off throttle differential pressure is Pp−Pr, a flow rate coefficient is Cf, and a hydraulic oil density is ρ, the controller calculates the bleed-off target opening area using the following formula.

$$\text{Bleed-off target}: At = \frac{Qb}{Cf}\sqrt{\frac{\rho}{2(Pp - Pr)}} \quad \text{[Mathematical Expression 1]}$$

In the work vehicle of the present invention, the controller calculates a speed deviation on a basis of a target operation speed of the hydraulic device and an actual operation speed of the hydraulic device, and controls the hydraulic oil control valve so that the speed deviation decreases.

In the work vehicle of the present invention, the controller controls the hydraulic oil control valve so as to reduce the speed deviation, by multiplying each of a proportional term which is the speed deviation and an integral term and a derivative term calculated on a basis of the speed deviation by a gain.

In the work vehicle of the present invention, when an actual operation speed of the hydraulic device becomes lower than a threshold after a target operation speed of the hydraulic device becomes zero, the controller controls the hydraulic oil control valve to block hydraulic oil fed to the hydraulic device.

In the work vehicle of the present invention, the controller changes the threshold on a basis of a mode selection status at an operation stop time.

Effects of the Invention

A work vehicle of the present invention includes an operation tool operated by an operator, and a controller that determines a target flow rate of hydraulic oil to be fed to a hydraulic device on a basis of an operation amount of the operation tool. Then, the controller calculates the bleed-off target flow rate on a basis of the flow rate of the hydraulic oil fed from the hydraulic oil pump and the target flow rate of the hydraulic oil fed to the hydraulic device, calculates the bleed-off throttle differential pressure on a basis of the pressure of the hydraulic oil fed from the hydraulic oil pump and the pressure of the hydraulic oil in the hydraulic oil tank, calculates the bleed-off target opening area on a basis of the bleed-off target flow rate and the bleed-off throttle differential pressure, and controls the hydraulic oil control valve such that the bleed-off target opening area is achieved. According to such a work vehicle, even if the operating state of the hydraulic oil pump changes according to the load applied to the engine, the operation amount of the operation tool and the flow rate of the hydraulic oil fed to the hydraulic device can be controlled to be proportional by adjusting the opening area of the bleed-off circuit. As a result, it is possible to achieve operation characteristics closely following the operation of the operator. Consequently, the operation performance can be improved. Additionally, since it is sufficient to store the information on the target flow rate of the hydraulic oil and the information on the opening area of the bleed-off circuit in the controller, it is possible to reduce the time and financial costs needed for research and development.

In the work vehicle of the present invention, the controller calculates the bleed-off target opening area using the following formula when the bleed-off target flow rate is Qb, the bleed-off throttle differential pressure is Pp−Pr, the flow rate coefficient is Cf, and the hydraulic oil density is ρ. According to such a work vehicle, the above-described effects can be obtained by a simple program. That is, it is possible to improve the operation performance. Additionally, it is possible to reduce the time and financial costs needed for research and development.

$$\text{Bleed-off target}: At = \frac{Qb}{Cf}\sqrt{\frac{\rho}{2(Pp - Pr)}} \quad \text{[Mathematical Expression 1]}$$

In the work vehicle of the present invention, the controller calculates a speed deviation on a basis of a target operation speed of the hydraulic device and an actual operation speed of the hydraulic device, and controls the hydraulic oil control valve so that the speed deviation decreases. According to such a work vehicle, even when a large disturbance is received, it is possible to achieve operation characteristics closely following the operation of the operator. Consequently, the operation performance can be improved.

In the work vehicle of the present invention, the controller controls the hydraulic oil control valve so as to reduce the speed deviation, by multiplying each of a proportional term which is the speed deviation and an integral term and a derivative term calculated on a basis of the speed deviation by a gain. According to such a work vehicle, the above-described effects can be obtained by a simple program. That is, it is possible to improve the operation performance.

In the work vehicle of the present invention, when an actual operation speed of the hydraulic device becomes lower than a threshold after a target operation speed of the hydraulic device becomes zero, the controller controls the hydraulic oil control valve to block hydraulic oil fed to the hydraulic device. According to such a work vehicle, it is possible to achieve both an appropriate high-speed response and appropriate impact suppression when the hydraulic device is stopped. Consequently, the operation performance can be improved.

In the work vehicle of the present invention, the controller changes the threshold on a basis of the mode selection status at an operation stop time. According to such a work vehicle, it is possible to achieve operation characteristics that emphasize higher speed response and operation characteristics that emphasize impact suppression. Consequently, the operation performance can be improved.

DESCRIPTION OF EMBODIMENTS

Figure 1:
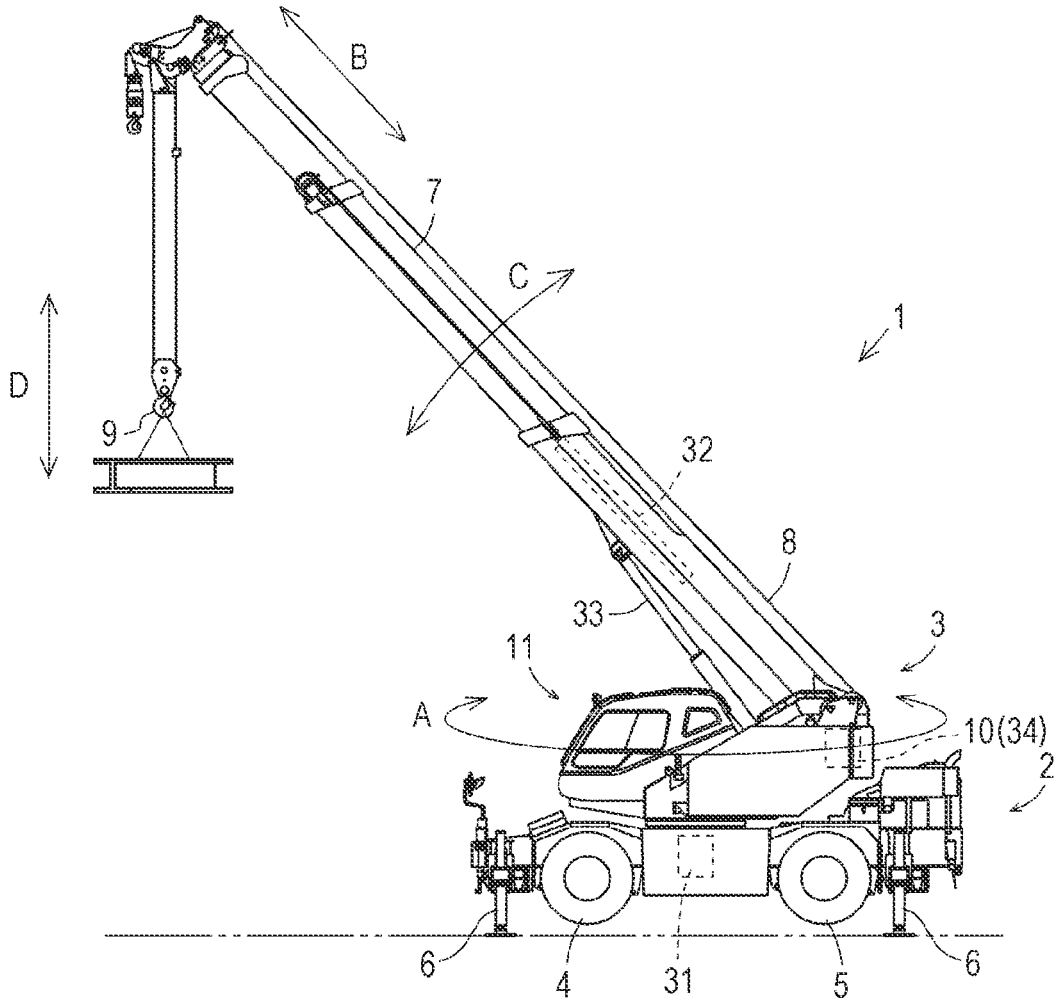
FIG. 1 is a diagram illustrating a crane.

The technical idea disclosed in the present application can be applied to other cranes in addition to a crane 1 described below.

First, the crane 1 will be described with reference to FIGS. 1 and 2.

The crane 1 mainly includes a travelling body 2 and a slewing body 3.

The travelling body 2 includes a pair of left and right front wheels 4 and a pair of left and right rear wheels 5. Additionally, the travelling body 2 includes an outrigger 6 that is brought into contact with the ground to achieve stability when transporting a load. Note that in the travelling body 2, the slewing body 3 supported on an upper portion thereof is rotatable by a hydraulic device.

The slewing body 3 includes a boom 7 protruding forward from a rear portion thereof. For this reason, the boom 7 is rotatable by the hydraulic device (see arrow A). Additionally, the boom 7 is extendable and retractable by the hydraulic device (see arrow B). Moreover, the boom 7 can be raised and lowered by the hydraulic device (see arrow C).

In addition, a wire rope 8 is stretched across the boom 7. A hook 9 is attached to the wire rope 8 hanging down from a tip end portion of the boom 7. Additionally, a winch 10 is disposed near the base end side of the boom 7. The winch 10 is formed integrally with the hydraulic device, and enables the wire rope 8 to be wound in and out. For this reason, the hook 9 can be raised and lowered by the hydraulic device (see arrow D). Note that the slewing body 3 includes a cabin 11 on the side of the boom 7. Inside the cabin 11, in addition to a controller 20 (see FIG. 3), a slewing lever 21, an extension/retraction lever 22, a derricking lever 23, and a winding lever 24 are provided.

The controller 20 mainly includes an information storage unit and an information processing unit. The information storage unit stores various information (programs and the like) required for controlling the crane 1. Additionally, the information processing unit converts operation amounts of the various levers 21 to 24 into electric signals and controls the hydraulic devices. In this way, the controller 20 achieves operation of the boom 7 (slewing operation, extension/retraction operation, derricking operation) and operation of the winch 10 (winding operation, unwinding operation).

Figure 2:
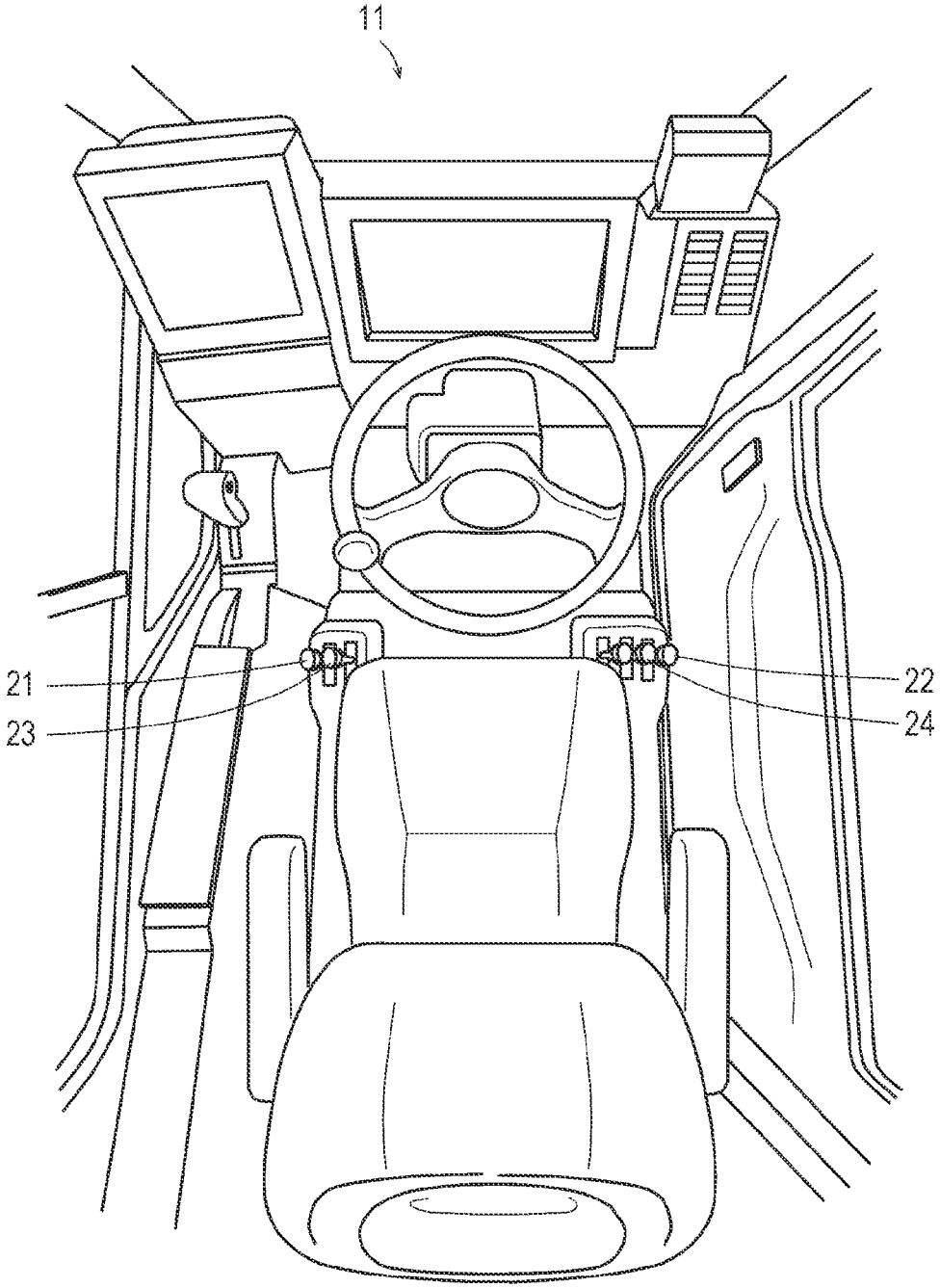
FIG. 2 is a diagram illustrating the inside of a cabin.

More specifically, the boom 7 is rotatable by the hydraulic device (see arrow A in FIG. 1). In the present application, such a hydraulic device is defined as a motor 31 for slewing. The motor 31 for slewing is operated appropriately by a hydraulic oil control valve 37 to be described later. That is, the motor 31 for slewing is operated appropriately by the hydraulic oil control valve 37 switching the flow rate and the flow direction of the hydraulic oil. Note that the operation speed of the motor 31 for slewing is detected by a sensor 25 (see FIG. 3).

Additionally, the boom 7 is extendable and retractable by a hydraulic device (see arrow B in FIG. 1). In the present application, such a hydraulic device is defined as an extension/retraction cylinder 32. The extension/retraction cylinder 32 is operated appropriately by another hydraulic oil control valve. That is, the extension/retraction cylinder 32 is operated appropriately by the hydraulic oil control valve switching the flow rate and the flow direction of the hydraulic oil. Note that the operation speed of the extension/retraction cylinder 32 is detected by a sensor (not illustrated).

Moreover, the boom 7 can be raised and lowered by a hydraulic device (see arrow C in FIG. 1). In the present application, such a hydraulic device is defined as a derricking cylinder 33. The derricking cylinder 33 is operated appropriately by another hydraulic oil control valve. That is, the derricking cylinder 33 is operated appropriately by the hydraulic oil control valve switching the flow rate and the flow direction of the hydraulic oil. Note that the operation speed of the derricking cylinder 33 is detected by a sensor (not illustrated).

In addition, the hook 9 can be raised and lowered by a hydraulic device (see arrow D in FIG. 1). In the present application, such a hydraulic device is defined as a motor 34 for winding. The motor 34 for winding is operated appropriately by another hydraulic oil control valve. That is, the motor 34 for winding is operated appropriately by the hydraulic oil control valve switching the flow rate and the flow direction of the hydraulic oil. Note that the operation speed of the motor 34 for winding is detected by a sensor (not illustrated).

Figure 3:
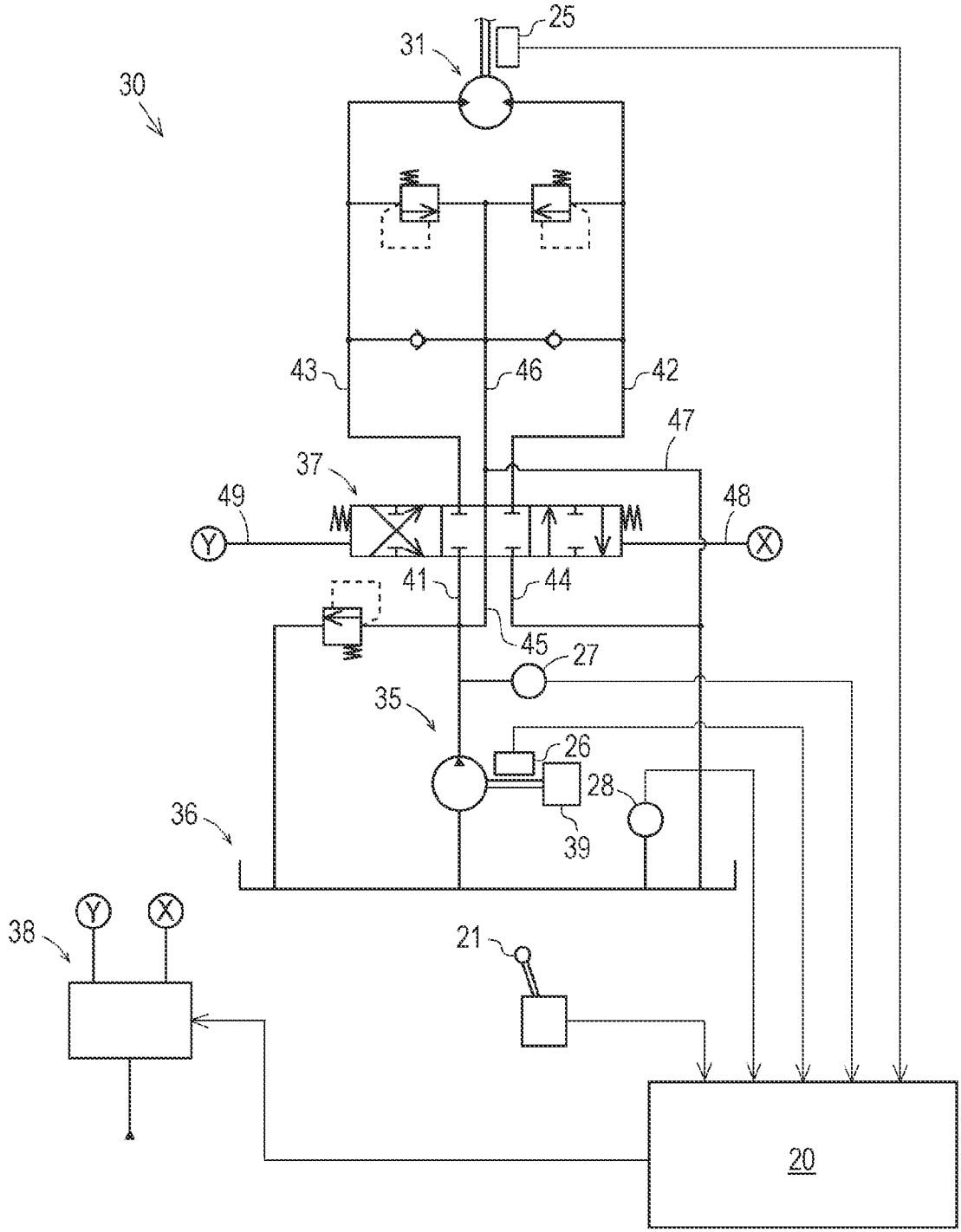
FIG. 3 is a diagram illustrating a configuration of a hydraulic system.
Figure 4:
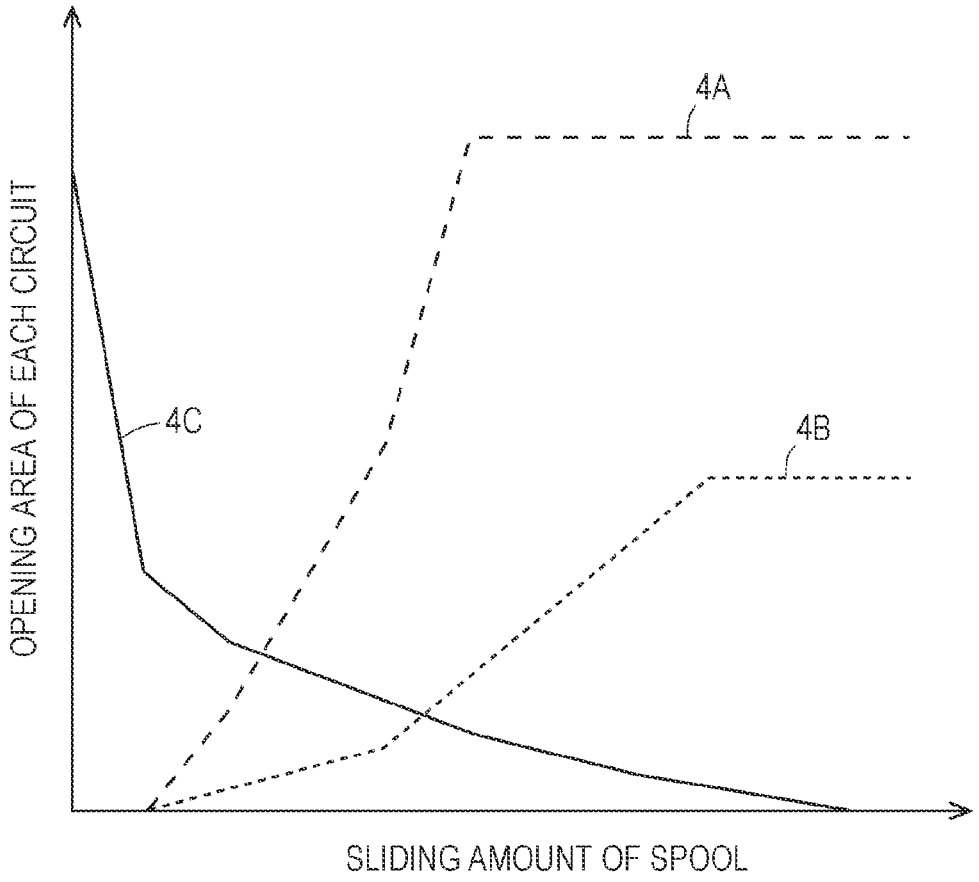
FIG. 4 is a diagram illustrating a relationship between a sliding amount of a spool and an opening area of each circuit.
Figure 5:
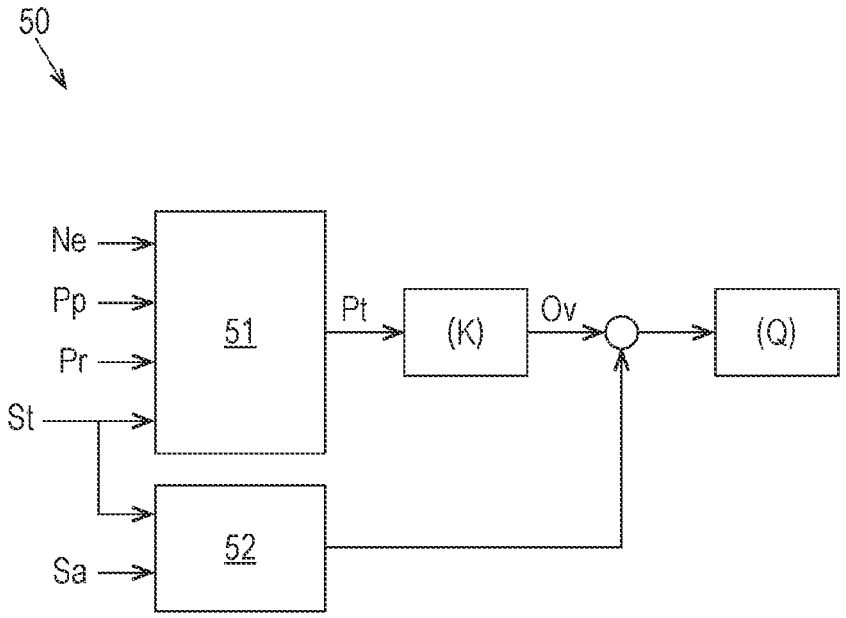
FIG. 5 is a diagram illustrating a configuration of a control system according to a first embodiment.
Figure 6:
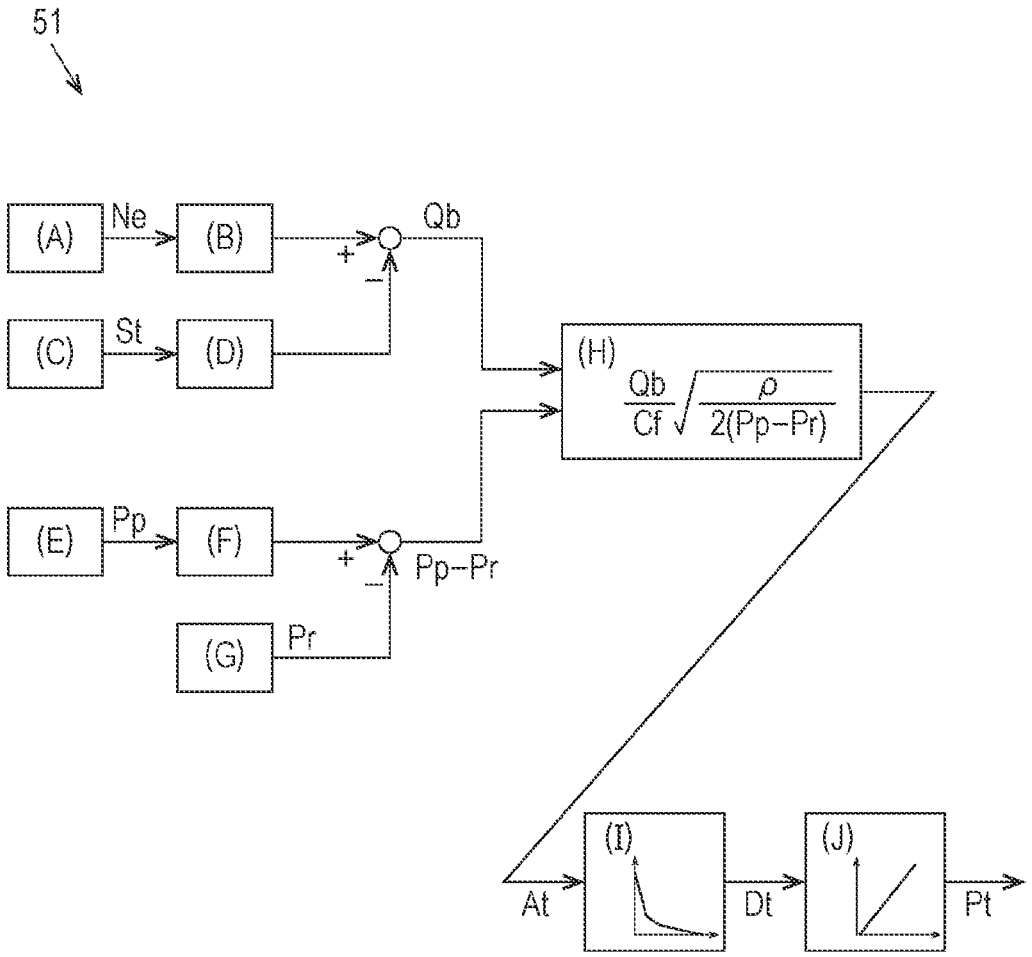
FIG. 6 is a diagram illustrating a feedforward controller in the control system.
Figure 7:
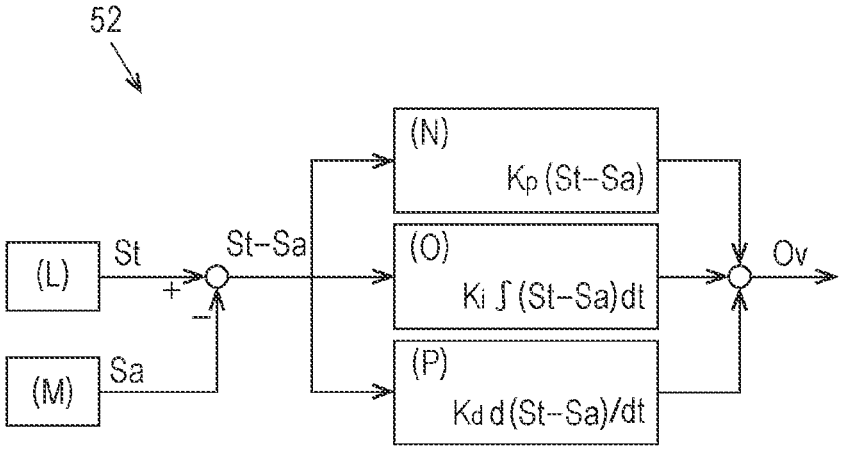
FIG. 7 is a diagram illustrating a feedback controller in the control system.
Figure 8:
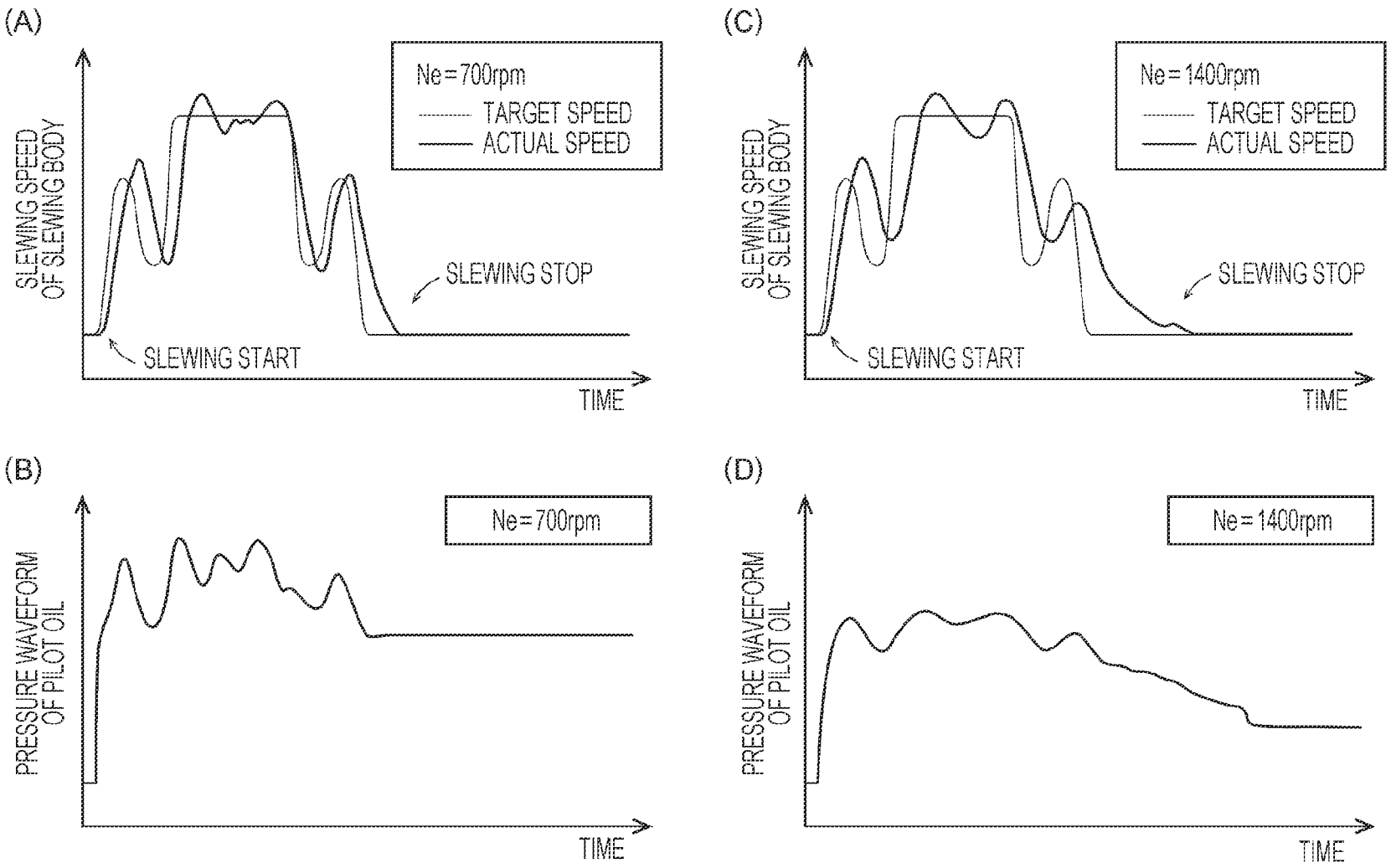
FIG. 8 is a diagram illustrating a slewing operation of a slewing body and a pressure waveform of pilot oil.

Next, a configuration of a hydraulic system 30 will be described with reference to FIGS. 3 and 4.

The hydraulic system 30 operates the motor 31 for slewing, which is one of the hydraulic devices. The hydraulic system 30 has a hydraulic oil pump 35 and a hydraulic oil tank 36. Additionally, the hydraulic system 30 has the hydraulic oil control valve 37.

The hydraulic oil pump 35 feeds hydraulic oil to the motor 31 for slewing. A circuit 41 connects the hydraulic oil pump 35 to the hydraulic oil control valve 37. Additionally, a circuit 42 and a circuit 43 connect the hydraulic oil control valve 37 to the motor 31 for slewing. For this reason, when the spool of the hydraulic oil control valve 37 slides to one side, hydraulic oil flows to the motor 31 for slewing through the circuits 41 and 42, and when the spool slides to the other side, hydraulic oil flows to the motor 31 for slewing through the circuits 41 and 43. At this time, since the opening area of each of the circuits 42 and 43 (opening area of port: see FIG. 4) changes according to the sliding amount of the spool, the flow rate of the hydraulic oil can be adjusted. Note that a circuit (41, 42 or 41, 43) that guides the hydraulic oil from the hydraulic oil pump 35 to the motor 31 for slewing is referred to as a "meter-in circuit". Hereinafter, the circuit is referred to as a meter-in circuit 4A.

The hydraulic oil tank 36 stores the hydraulic oil returned from the motor 31 for slewing. The circuit 42 and the circuit 43 connect the motor 31 for slewing to the hydraulic oil control valve 37. Additionally, a circuit 44 connects the hydraulic oil control valve 37 to the hydraulic oil tank 36. For this reason, when the spool of the hydraulic oil control valve 37 slides to one side, hydraulic oil flows to the hydraulic oil tank 36 through the circuits 43 and 44, and when the spool slides to the other side, hydraulic oil flows to the hydraulic oil tank 36 through the circuits 42 and 44. At this time, since the opening area of the circuit 44 (opening area of port: see FIG. 4) changes according to the sliding amount of the spool, the flow rate of the hydraulic oil can be adjusted. Note that a circuit (43, 44 or 42, 44) that guides the hydraulic oil from the motor 31 for slewing to the hydraulic oil tank 36 is referred to as a "meter-out circuit". Hereinafter, the circuit is referred to as a meter-out circuit 4B.

In addition, in the present hydraulic system 30, a circuit 45 branched from the circuit 41 is also connected to the hydraulic oil control valve 37. Additionally, a circuit 46 branched from the circuit 42 and the circuit 43 is also connected to the hydraulic oil control valve 37. Moreover, a circuit 47 branched from the circuit 46 is connected to the hydraulic oil tank 36. The hydraulic oil control valve 37 connects the circuit 45 and the circuit 46 (center bypass type) when the spool is at the neutral position or slides in any direction. For this reason, when the spool of the hydraulic oil control valve 37 is at the neutral position or slides in any direction, the hydraulic oil flows to the hydraulic oil tank 36 through the circuits 45, 46, and 47. At this time, since the opening area of the circuit 46 (opening area of port: see FIG. 4) changes according to the sliding amount of the spool, the flow rate of the hydraulic oil can be adjusted. Note that a circuit (45, 46, 47) that guides the hydraulic oil from the hydraulic oil pump 35 to the hydraulic oil tank 36 without passing through the motor 31 for slewing is referred to as a "bleed-off circuit". Hereinafter, the circuit is referred to as a bleed-off circuit 4C.

Furthermore, in the present hydraulic system 30, the spool of the hydraulic oil control valve 37 is slid by the pressure of the pilot oil. A pilot pressure control valve 38 is provided to set the pilot oil to a pressure corresponding to the operation amount of the slewing lever 21. The pilot pressure control valve 38 is connected to a circuit 48 that guides hydraulic oil to an oil chamber on one end side of the hydraulic oil control valve 37. For this reason, when the operator grips and tilts the slewing lever 21 to one side, the spool of the hydraulic oil control valve 37 is pushed to one side by the pressure of the pilot oil corresponding to the operation amount. At this time, the operation amount of the slewing lever 21 and the sliding amount of the spool have a proportional relationship. The pilot pressure control valve 38 is connected to a circuit 49 that guides hydraulic oil to an oil chamber on the other end side of the hydraulic oil control valve 37. For this reason, when the operator grips and tilts the slewing lever 21 to the other side, the spool of the hydraulic oil control valve 37 is pushed to the other side by the pressure of the pilot oil corresponding to the operation amount. At this time, too, the operation amount of the slewing lever 21 and the sliding amount of the spool have a proportional relationship.

Incidentally, the hydraulic oil pump 35 is operated by an engine 39. For this reason, when the load applied to the engine 39 changes, the operating state of the hydraulic oil pump 35 also changes. That is, when the load applied to the engine 39 increases, the rotation speed of the engine 39 decreases, so that the operation speed of the hydraulic oil pump 35 also decreases. Then, the flow rate of the hydraulic oil fed from the hydraulic oil pump 35 decreases. On the other hand, when the load applied to the engine 39 decreases, the rotation speed of the engine 39 increases, so that the operation speed of the hydraulic oil pump 35 also increases. Then, the flow rate of the hydraulic oil fed from the hydraulic oil pump 35 increases. Note that the rotation speed of the engine 39 is detected by a sensor 26. The rotation speed of the engine 39 is synonymous with the operation speed of the hydraulic oil pump 35. Moreover, the differential pressure across the hydraulic oil control valve 37 in the bleed-off circuit 4C (hereinafter referred to as "bleed-off throttle differential pressure") corresponds to the difference between the pressure of the hydraulic oil fed from the hydraulic oil pump 35 and the pressure of the hydraulic oil in the hydraulic oil tank 36. Accordingly, in the crane 1, the pressure of the hydraulic oil fed from the hydraulic oil pump 35 is detected by a sensor 27, and the pressure of the hydraulic oil in the hydraulic oil tank 36 is detected by a sensor 28. Note, however, that considering that the pressure of the hydraulic oil in the hydraulic oil tank 36 is equal to the atmospheric pressure, the sensor 28 is not necessarily required.

Hereinafter, a configuration of a control system 50 according to a first embodiment will be described with reference to FIGS. 5 to 8. Here, reference numerals (A), (B), (C), . . . in the description coincide with reference numerals (A), (B), (C), . . . in the drawings.

The control system 50 slides the spool of the hydraulic oil control valve 37 appropriately. The control system 50 has a feedforward controller 51 and a feedback controller 52.

First, the feedforward controller 51 will be described. The feedforward controller 51 continuously functions from the start to the stop of the slewing operation of the slewing body 3.

The feedforward controller 51 grasps a rotational speed Ne of the engine 39 on the basis of a detection signal of the sensor 26 (A). Then, the feedforward controller 51 calculates the flow rate of the hydraulic oil fed from the hydraulic oil pump 35 on the basis of the rotational speed Ne of the engine 39 (B). At the same time, the feedforward controller 51 grasps a target operation speed St of the motor 31 for slewing corresponding to the operation amount of the slewing lever 21 (C). Then, the feedforward controller 51 calculates a target flow rate of the hydraulic oil fed to the motor 31 for slewing on the basis of the target operation speed St of the motor 31 for slewing (D). Thereafter, the feedforward controller 51 calculates a bleed-off target flow rate Qb on the basis of the flow rate of the hydraulic oil fed from the hydraulic oil pump 35 and the target flow rate of the hydraulic oil fed to the motor 31 for slewing.

Additionally, the feedforward controller 51 grasps a pressure Pp of the hydraulic oil fed from the hydraulic oil pump 35 on the basis of a detection signal of the sensor 27 (E). The feedforward controller 51 applies a low-pass filter to the pressure waveform (F). At the same time, the feedforward controller 51 grasps a pressure Pr of the hydraulic oil in the hydraulic oil tank 36 on the basis of a detection signal of the sensor 28 (G). At this time, the pressure of the hydraulic oil in the hydraulic oil tank 36 may be mechanically set to 0 MPa assuming that the pressure is equal to the atmospheric pressure. Thereafter, the feedforward controller 51 calculates a bleed-off throttle differential pressure Pp−Pr on the basis of the pressure Pp of the hydraulic oil fed from the hydraulic oil pump 35 and the pressure Pr of the hydraulic oil in the hydraulic oil tank 36.

Moreover, the feedforward controller 51 calculates a bleed-off target opening area At from the bleed-off target flow rate Qb and the bleed-off throttle differential pressure Pp−Pr (H). At this time, the feedforward controller 51 calculates the bleed-off target opening area At using the following formula (orifice formula). Note that in this formula, the flow rate coefficient is Cf, and the hydraulic oil density is ρ.

$$\text{Bleed-off target}: At = \frac{Qb}{Cf}\sqrt{\frac{\rho}{2(Pp - Pr)}} \quad \text{[Mathematical Expression 1]}$$

In addition, the feedforward controller 51 reads a spool target sliding amount Dt on the basis of a conversion table representing the relationship between the sliding amount of the spool and the opening area of the bleed-off circuit 4C (I). That is, the feedforward controller 51 reads the spool target sliding amount Dt in which the opening area of the bleed-off circuit 4C becomes the bleed-off target opening area At. Thereafter, the feedforward controller 51 reads a pilot oil target pressure Pt on the basis of a conversion table representing the relationship between the pressure of the pilot oil and the sliding amount of the spool (J). That is, the feedforward controller 51 reads the pilot oil target pressure Pt at which the sliding amount of the spool becomes the spool target sliding amount Dt. In this manner, the feedforward controller 51 determines the pilot oil target pressure Pt. Note that the pilot oil target pressure Pt is converted into an operation voltage Ov of the pilot pressure control valve 38 (K).

Next, the feedback controller 52 will be described. The feedback controller 52 also continuously functions from the start to the stop of the slewing operation of the slewing body 3.

The feedback controller 52 grasps the target operation speed St of the motor 31 for slewing corresponding to the operation amount of the slewing lever 21 (L). This is synonymous with the target slewing speed of the slewing body 3. At the same time, the feedback controller 52 grasps the actual operation speed Sa of the motor 31 for slewing on the basis of a detection signal of the sensor 25 (M). This is synonymous with the actual slewing speed of the slewing body 3. Thereafter, the feedback controller 52 calculates a speed deviation St-Sa on the basis of the target operation speed St of the motor 31 for slewing and the actual operation speed Sa of the motor 31 for slewing.

Additionally, the feedback controller 52 calculates an operation amount by multiplying a proportional term that is the speed deviation St-Sa by a predetermined gain (proportional gain Kp) (N). Such a control method is called proportional control because the operation amount is changed in proportion to the deviation. In general, when proportional control is added, the smaller the deviation, the smaller the operation amount, and the larger the deviation, the larger the operation amount. If the proportional gain Kp is determined appropriately, the rise of the operation for converging the deviation becomes faster.

Moreover, the feedback controller 52 calculates an operation amount by multiplying the integral term calculated on the basis of the speed deviation St-Sa by a predetermined gain (integral gain Ki) (O). Such a control method is called integral control because the operation amount is changed in proportion to the integral of the deviation. In general, when integral control is applied, the smaller the integral of the deviation, the smaller the operation amount, and the larger the integral of the deviation, the larger the operation amount. If the integral gain Ki is determined appropriately, although it takes a little time, the deviation can be converged.

In addition, the feedback controller 52 calculates an operation amount by multiplying the derivative term calculated on the basis of the speed deviation St-Sa by a predetermined gain (derivative gain Kd) (P). Such a control method is called derivative control because the operation amount is changed in proportion to the derivative of the deviation. In general, when derivative control is applied, the smaller the derivative of the deviation, the smaller the operation amount, and the larger the derivative of the deviation, the larger the operation amount. If the derivative gain Kd is determined appropriately, an overshoot and a vibration phenomenon can be curbed.

With such a control system 50, the controller 20 can always apply an appropriate operation voltage Ov to the amplifier of the pilot pressure control valve 38 (Q). Note, however, that the feedback controller 52 is not limited to such PID control. For example, PI control, PD control, or other control may be used.

An example of the effect of the control system 50 is as follows. That is, even if the operation amount of the slewing lever 21 is the same, if the rotational speed Ne of the engine 39 is low, the hydraulic oil fed from the hydraulic oil pump 35 decreases. Hence, the flow rate of the bleed-off circuit 4C is reduced by increasing the pressure of the pilot oil to increase the sliding amount of the spool. Regarding this, it can be seen from (A) and (B) of FIG. 8 that the pressure of the pilot oil is maintained high from the start to the stop of the slewing operation. Conversely, even if the operation amount of the slewing lever 21 is the same, if the rotational speed Ne of the engine 39 is high, the hydraulic oil fed from the hydraulic oil pump 35 increases. Hence, the flow rate of the bleed-off circuit 4C is increased by lowering the pressure of the pilot oil to reduce the sliding amount of the spool. Regarding this, it can be seen from (C) and (D) of FIG. 8 that the pressure of the pilot oil is maintained low from the start to the stop of the slewing operation.

As described above, the crane 1 includes the operation tool (slewing lever 21) operated by the operator, and the controller 20 that determines the target flow rate of the hydraulic oil to be fed to the hydraulic device (motor 31 for slewing) on the basis of the operation amount of the operation tool (21). Then, the controller 20 calculates the bleed-off target flow rate Qb on the basis of the flow rate of the hydraulic oil fed from the hydraulic oil pump 35 and the target flow rate of the hydraulic oil fed to the hydraulic device (31), calculates the bleed-off throttle differential pressure Pp−Pr on the basis of the pressure Pp of the hydraulic oil fed from the hydraulic oil pump 35 and the pressure Pr of the hydraulic oil in the hydraulic oil tank 36, calculates the bleed-off target opening area At on the basis of the bleed-off target flow rate Qb and the bleed-off throttle differential pressure Pp−Pr, and controls the hydraulic oil control valve 37 such that the bleed-off target opening area At is achieved. According to such a crane 1, even if the operating state of the hydraulic oil pump 35 changes according to the load applied to the engine 39, the operation amount of the operation tool (21) and the flow rate of the hydraulic oil fed to the hydraulic device (31) can be controlled to be proportional by adjusting the opening area of the bleed-off circuit 4C. As a result, it is possible to achieve operation characteristics closely following the operation of the operator. Consequently, the operation performance can be improved. Additionally, since it is sufficient to store the information on the target flow rate of the hydraulic oil and the information on the opening area of the bleed-off circuit 4C in the controller 20, it is possible to reduce the time and financial costs needed for research and development.

Additionally, in the crane 1, the controller 20 calculates the bleed-off target opening area At using the following formula when the bleed-off target flow rate is Qb, the bleed-off throttle differential pressure is Pp−Pr, the flow rate coefficient is Cf, and the hydraulic oil density is ρ. According to such a crane 1, the above-described effects can be obtained by a simple program. That is, it is possible to improve the operation performance. Additionally, it is possible to reduce the time and financial costs needed for research and development.

$$\text{Bleed-off target}: At = \frac{Qb}{Cf}\sqrt{\frac{\rho}{2(Pp - Pr)}} \quad \text{[Mathematical Expression 1]}$$

Moreover, in the crane 1, the controller 20 calculates the speed deviation St−Sa on the basis of the target operation speed St of the hydraulic device (motor 31 for slewing) and the actual operation speed Sa of the hydraulic device (31), and controls the hydraulic oil control valve 37 so that the speed deviation St−Sa decreases. According to such a crane 1, even if a large disturbance is received, it is possible to achieve operation characteristics closely following the operation of the operator. Consequently, the operation performance can be improved.

In addition, in the crane 1, the controller 20 controls the hydraulic oil control valve 37 so as to reduce the speed deviation St−Sa, by multiplying each of the proportional term which is the speed deviation St−Sa and the integral term and the derivative term calculated on the basis of the speed deviation St−Sa by the gain. According to such a crane 1, the above-described effects can be obtained by a simple program. That is, it is possible to improve the operation performance.

Figure 9:
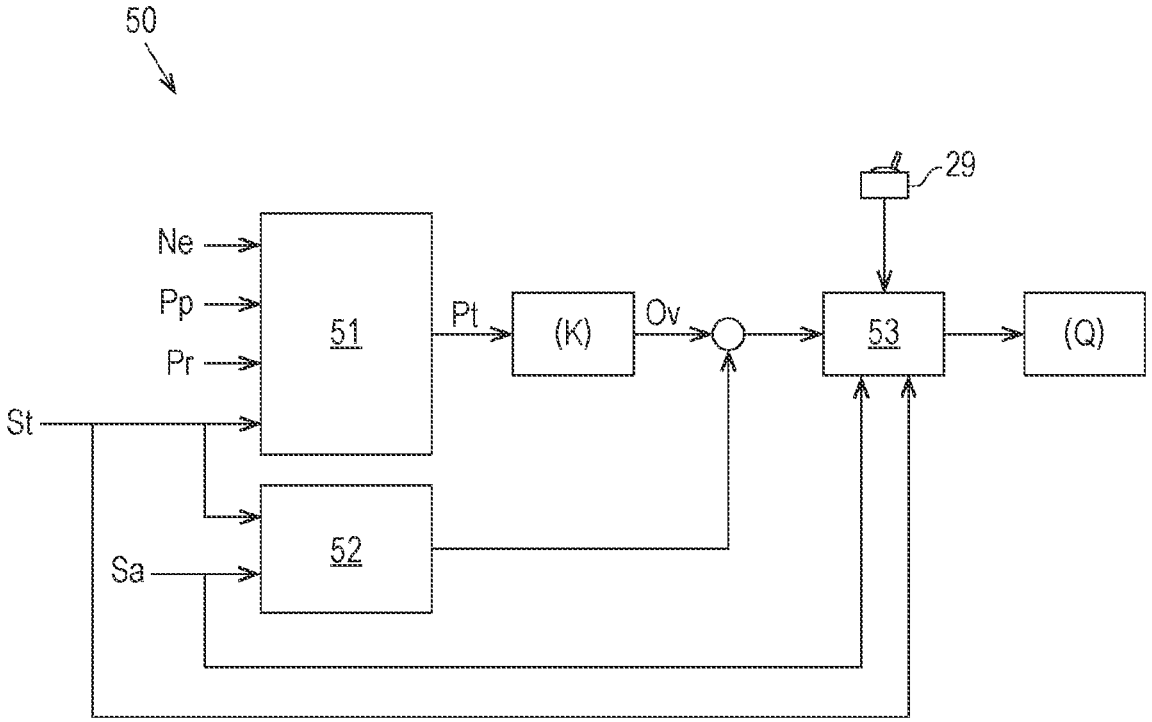
FIG. 9 is a diagram illustrating a configuration of a control system according to a second embodiment.
Figure 10:
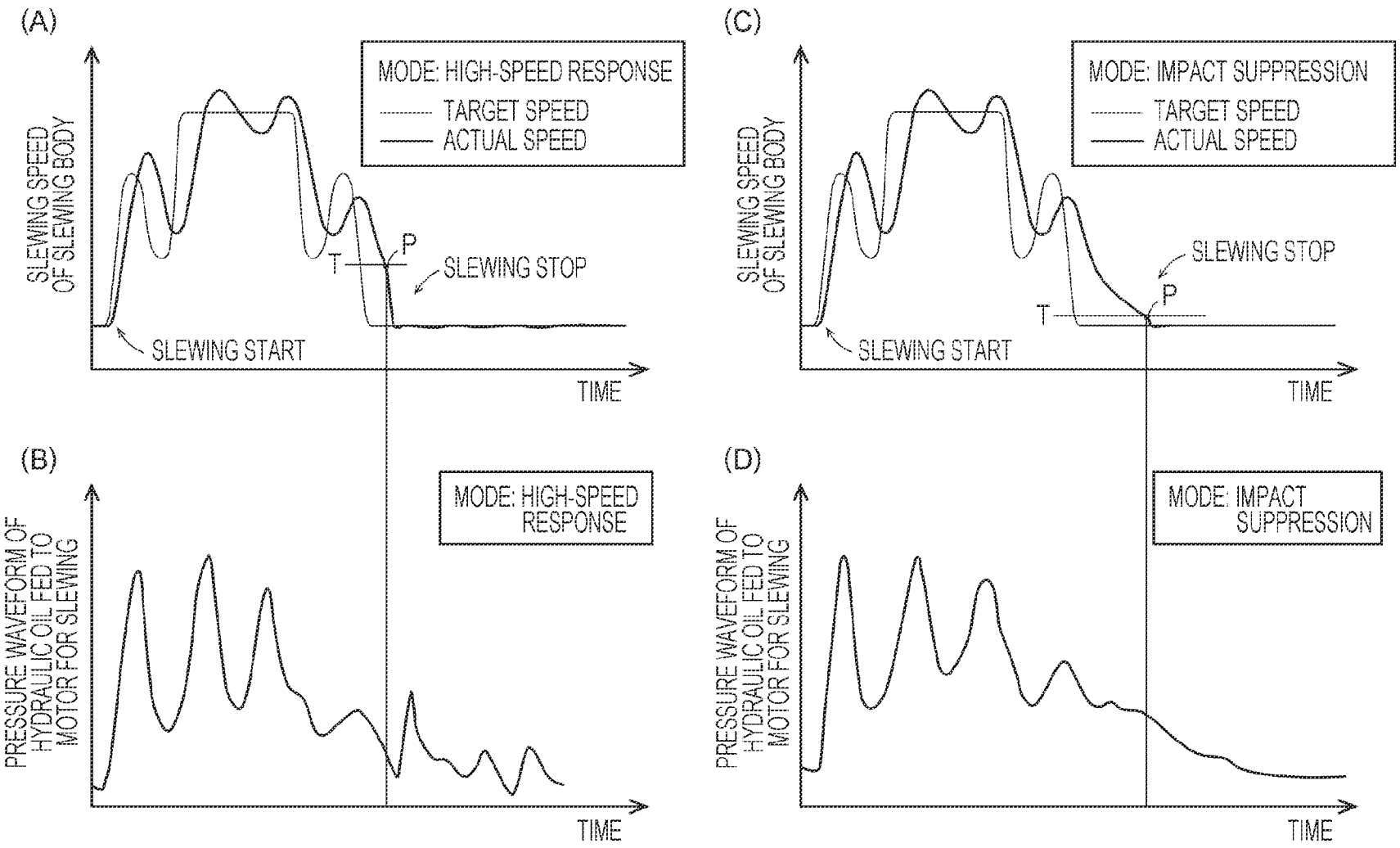
FIG. 10 is a diagram illustrating a slewing operation of the slewing body and a pressure waveform of hydraulic oil fed to a motor for slewing.

Hereinafter, a configuration of a control system 50 according to a second embodiment will be described with reference to FIGS. 9 and 10. Here, only portions different from the control system 50 according to the first embodiment will be described.

The control system 50 has a mode-specific stop control unit 53 in addition to a feedforward controller 51 and a feedback controller 52. The mode-specific stop control unit 53 functions when a slewing body 3 stops the swinging operation.

The mode-specific stop control unit 53 can select a mode in which high-speed response is emphasized or a mode in which impact suppression is emphasized by operating a switch 29. Note, however, that a controller 20 may automatically select the mode in accordance with various operating environments.

The mode-specific stop control unit 53 grasps an operation voltage Ov of a pilot pressure control valve 38. Then, the mode-specific stop control unit 53 applies the operation voltage Ov to an amplifier of a pilot pressure control valve 38 (Q). At the same time, the mode-specific stop control unit 53 grasps a target operation speed St of a motor 31 for slewing corresponding to the operation amount of a slewing lever 21. Additionally, the mode-specific stop control unit 53 grasps an actual operation speed Sa of the motor 31 for slewing on the basis of a detection signal of a sensor 25.

Moreover, the mode-specific stop control unit 53 grasps the mode selection status at an operation stop time. Then, when the actual operation speed Sa of the motor 31 for slewing becomes smaller than a threshold T after the target operation speed St of the motor 31 for slewing becomes 0, the mode-specific stop control unit 53 controls a hydraulic oil control valve 37 to block the hydraulic oil fed to the motor 31 for slewing (see point P in (A) and (C) of FIG. 10).

In this regard, the mode-specific stop control unit 53 changes the threshold T according to the selected mode. More specifically, the threshold T is shifted to a position higher than normal (see (A) of FIG. 10) when the mode in which the high-speed response is emphasized is selected, and the threshold T is shifted to a position lower than normal (see (C) of FIG. 10) when the mode in which the impact suppression is emphasized is selected. With this configuration, when a mode focusing on high-speed response is selected, the hydraulic oil fed to the motor 31 for slewing is blocked even if the slewing body 3 still continues the slewing operation. Hence, the slewing body 3 can be stopped quickly. On the other hand, when the mode focusing on the impact suppression is selected, the hydraulic oil fed to the motor 31 for slewing is blocked when the slewing body 3 stops or almost stops the slewing operation. Hence, the slewing body 3 can be stopped smoothly.

As described above, in the crane 1, when the actual operation speed Sa of the hydraulic device (31) becomes lower than the threshold T after the target operation speed St of the hydraulic device (motor 31 for slewing) becomes 0, the controller 20 controls the hydraulic oil control valve 37 to block the hydraulic oil fed to the hydraulic device (31). According to such a crane 1, it is possible to achieve both an appropriate high-speed response and appropriate impact suppression when the hydraulic device (31) is stopped. Consequently, the operation performance can be improved.

Additionally, in the crane 1, the controller 20 changes the threshold T on the basis of the mode selection status at an operation stop time. According to such a crane 1, it is possible to achieve operation characteristics that emphasize higher speed response and operation characteristics that emphasize impact suppression. Consequently, the operation performance can be improved.

Finally, in the present application, the description has been given focusing on the slewing motion of the slewing body 3 by using the motor 31 for slewing as the hydraulic device, but the present invention is not limited thereto. That is, the technical idea disclosed in the present application can be applied to the extension/retraction operation of the boom 7 by using the extension/retraction cylinder 32 as the hydraulic device. Additionally, the technical idea can be applied to the derricking operation of the boom 7 by using the derricking cylinder 33 as the hydraulic device. Moreover, the technical idea can be applied to the winding operation of the winch 10 by using the motor 34 for winding as the hydraulic device. In addition, in the present application, the description has been given using the crane 1, but the present invention is not limited thereto. That is, the technical idea disclosed in the present application can be applied to any work vehicle including a hydraulic device.

REFERENCE SIGNS LIST

1 crane
2 travelling body
3 slewing body
7 boom
20 controller
21 slewing lever (operation tool)
22 extension/retraction lever (operation tool)
23 derricking lever (operation tool)
24 winding lever (operation tool)
30 hydraulic system
31 motor for slewing (hydraulic device)
32 extension/retraction cylinder (hydraulic device)
33 derricking cylinder (hydraulic device)
34 motor for winding (hydraulic device)
35 hydraulic oil pump
36 hydraulic oil tank
37 hydraulic oil control valve
38 pilot pressure control valve
50 control system
51 feedforward controller
52 feedback controller
53 mode-specific stop control unit
4A meter-in circuit
4B meter-out circuit
4C bleed-off circuit
At bleed-off target opening area
Qb bleed-off target flow rate
Pp−Pr bleed-off throttle differential pressure
T threshold

The invention claimed is:

1. A work vehicle comprising:
a hydraulic device;
a hydraulic oil pump;
a hydraulic oil tank;
a meter-in circuit that guides hydraulic oil from the hydraulic oil pump to the hydraulic device;
a meter-out circuit that guides hydraulic oil from the hydraulic device to the hydraulic oil tank;
a bleed-off circuit that guides hydraulic oil from the hydraulic oil pump to the hydraulic oil tank without passing through the hydraulic device;
a hydraulic oil control valve that adjusts opening areas of the meter-in circuit, the meter-out circuit, and the bleed-off circuit by sliding of a spool;
an operation tool operated by an operator; and
a controller that determines a target flow rate of hydraulic oil to be fed to the hydraulic device on a basis of an operation amount of the operation tool, wherein
the controller calculates a bleed-off target flow rate on a basis of a flow rate of the hydraulic oil fed from the hydraulic oil pump and a target flow rate of the hydraulic oil fed to the hydraulic device, calculates a bleed-off throttle differential pressure on a basis of a pressure of the hydraulic oil fed from the hydraulic oil pump and a pressure of the hydraulic oil in the hydraulic oil tank, calculates a bleed-off target opening area on a basis of the bleed-off target flow rate and the bleed-off throttle differential pressure, and controls the hydraulic oil control valve such that the bleed-off target opening area is achieved.

2. The work vehicle according to claim 1, wherein when the bleed-off target flow rate is Qb, the bleed-off throttle differential pressure is Pp−Pr, a flow rate coefficient is Cf, and a hydraulic oil density is p, the controller calculates the bleed-off target opening area using the following formula.

$$\text{Bleed-off target}: At = \frac{Qb}{Cf}\sqrt{\frac{\rho}{2(Pp - Pr)}}$$ [Mathematical Expression 1]

3. The work vehicle according to claim 1, wherein the controller calculates a speed deviation on a basis of a target operation speed of the hydraulic device and an actual operation speed of the hydraulic device, and controls the hydraulic oil control valve so that the speed deviation decreases.

4. The work vehicle according to claim 3, wherein the controller controls the hydraulic oil control valve so as to reduce the speed deviation, by multiplying each of a proportional term which is the speed deviation and an integral term and a derivative term calculated on a basis of the speed deviation by a gain.

5. The work vehicle according to claim 1, wherein when an actual operation speed of the hydraulic device becomes lower than a threshold after a target operation speed of the hydraulic device becomes zero, the controller controls the hydraulic oil control valve to block hydraulic oil fed to the hydraulic device.

6. The work vehicle according to claim 5, wherein the controller changes the threshold on a basis of a mode selection status at an operation stop time.

* * * * *